US007874356B2

(12) United States Patent
Corre et al.

(10) Patent No.: US 7,874,356 B2
(45) Date of Patent: Jan. 25, 2011

(54) SINGLE PACKER SYSTEM FOR COLLECTING FLUID IN A WELLBORE

(75) Inventors: Pierre-Yves Corre, Eu (FR); Stephane Metayer, Abbeville (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 12 days.

(21) Appl. No.: 12/138,518

(22) Filed: Jun. 13, 2008

(65) Prior Publication Data

US 2009/0308604 A1 Dec. 17, 2009

(51) Int. Cl.
*E21B 49/10* (2006.01)

(52) U.S. Cl. ..... 166/187; 175/59

(58) Field of Classification Search ..... 166/187, 166/264; 175/59

See application file for complete search history.

(56) References Cited

U.S. PATENT DOCUMENTS

| | | | | |
|---|---|---|---|---|
| 2,441,894 | A | 5/1948 | Mennecier | |
| 2,511,759 | A | 6/1950 | Williams | |
| 2,516,580 | A * | 7/1950 | Lynes | 166/141 |
| 2,581,070 | A | 1/1952 | Blood | |
| 2,600,173 | A | 6/1952 | Sewell et al. | |
| 2,623,594 | A | 12/1952 | Sewell | |
| 2,675,080 | A | 4/1954 | Williams | |
| 2,742,968 | A | 4/1956 | Hildebrandt | |
| 2,842,210 | A | 7/1958 | Ramsey | |
| 2,843,208 | A | 7/1958 | Blood | |
| 3,915,229 | A | 10/1975 | Nicolas | |
| 3,926,254 | A | 12/1975 | Evans et al. | |
| 4,236,113 | A | 11/1980 | Wiley | |
| 4,500,095 | A | 2/1985 | Schisler et al. | |
| 4,830,105 | A | 5/1989 | Petermann | |
| 4,886,117 | A | 12/1989 | Patel | |
| 4,923,007 | A | 5/1990 | Sanford et al. | |
| 5,358,039 | A | 10/1994 | Fordham | |
| 5,361,836 | A | 11/1994 | Sorem et al. | |
| 5,404,947 | A | 4/1995 | Sorem et al. | |
| 5,439,053 | A | 8/1995 | Eslinger et al. | |
| 5,549,159 | A * | 8/1996 | Shwe et al. | 166/250.02 |
| 5,605,195 | A | 2/1997 | Eslinger et al. | |
| 5,613,555 | A | 3/1997 | Sorem et al. | |
| 5,687,795 | A | 11/1997 | Patel et al. | |
| 6,315,050 | B2 | 11/2001 | Vaynshteyn et al. | |
| 6,513,600 | B2 | 2/2003 | Ross | |
| 6,564,876 | B2 | 5/2003 | Vaynshteyn et al. | |
| 6,729,399 | B2 | 5/2004 | Follini et al. | |
| 6,865,933 | B1 * | 3/2005 | Einarson et al. | 73/152.23 |
| 6,938,698 | B2 | 9/2005 | Coronado | |
| 2002/0014339 | A1 | 2/2002 | Ross | |

(Continued)

FOREIGN PATENT DOCUMENTS

| | | |
|---|---|---|
| EP | 0528327 | 2/1993 |

(Continued)

*Primary Examiner*—William P Neuder
(74) *Attorney, Agent, or Firm*—Michael L. Flynn; David Hofman; Jody Lynn DeStefani

(57) ABSTRACT

A technique involves collecting formation fluids through a single packer having a plurality of sample collectors disposed along an expandable packer element. An anti-expansion device also is deployed along the expandable packer element to limit expansion in localized regions. Limiting the expansion can provide additional space or an increased production surface that facilitates collection of samples.

22 Claims, 4 Drawing Sheets

U.S. PATENT DOCUMENTS

| | | | | |
|---|---|---|---|---|
| 2002/0017386 | A1 | 2/2002 | Ringgenberg et al. | |
| 2004/0099443 | A1 | 5/2004 | Meister et al. | |
| 2007/0151724 | A1 * | 7/2007 | Ohmer et al. | 166/187 |

FOREIGN PATENT DOCUMENTS

| | | |
|---|---|---|
| EP | 0528328 | 2/1993 |
| EP | 0702747 | 3/1996 |
| WO | 03/018956 | 3/2003 |

* cited by examiner

SINGLE PACKER SYSTEM FOR COLLECTING FLUID IN A WELLBORE

BACKGROUND

A variety of packers are used in wellbores to isolate specific wellbore regions. A packer is delivered downhole on a tubing string and a packer sealing element is expanded against the surrounding wellbore wall to isolate a region of the wellbore. Often, two or more packers can be used to isolate one or more regions in a variety of well related applications, including production applications, service applications and testing applications.

In some applications, packers are used to isolate regions for collection of formation fluids. For example, a straddle packer can be used to isolate a specific region of the wellbore to allow collection of fluids. A straddle packer uses a dual packer configuration in which fluids are collected between two separate packers. The dual packer configuration, however, is susceptible to mechanical stresses which limit the expansion ratio and the drawdown pressure differential that can be employed.

SUMMARY

In general, the present invention provides a system and method for collecting formation fluids through a single packer having one or more sample collectors disposed along an expandable packer element. Additionally, an anti-expansion device is deployed along the expandable packer element to limit expansion in localized regions. Depending on the application, the localized regions may be proximate individual sample collectors to effectively provide space between each sample collector and a surrounding wellbore wall. The spacing helps maximize the production surface of the single packer. In some embodiments, the presence of more than one localized region enables performance of focused sampling.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for collecting formation fluids through an individual sample collector or a plurality of sample collectors disposed along an expandable packer element. The collected formation fluids are conveyed through tubes within the packer to a tool flow line and then directed to a desired collection location. Use of the single packer enables collection applications with larger expansion ratios and higher drawdown pressure differentials. Additionally, the single packer configuration reduces the stresses otherwise incurred by the packer tool mandrel due to the differential pressures. Because the packer is a single packer, the expandable packer sealing element is better able to support the formation in a produced zone at which formation fluids are collected. This quality facilitates relatively large amplitude draw-downs even in weak, unconsolidated formations. Also, a plurality of sample collectors can be used to perform focused sampling with the single packer.

The single packer can be expanded across an expansion zone, and formation fluids are collected from the middle of the expansion zone, i.e. between axial ends of the outer sealing layer. The expansion ratio is limited at localized regions within the expansion zone between ends of the packer sealing element. For example, the expansion ratio can be limited in the one or more collecting zones in which fluid collectors are used to collect formation fluid. By restricting expansion of the packer at specific regions, the fluid collectors can be prevented from contacting the surrounding wellbore wall which, in turn, increases the production surface through which fluid samples are collected.

Figure 1:
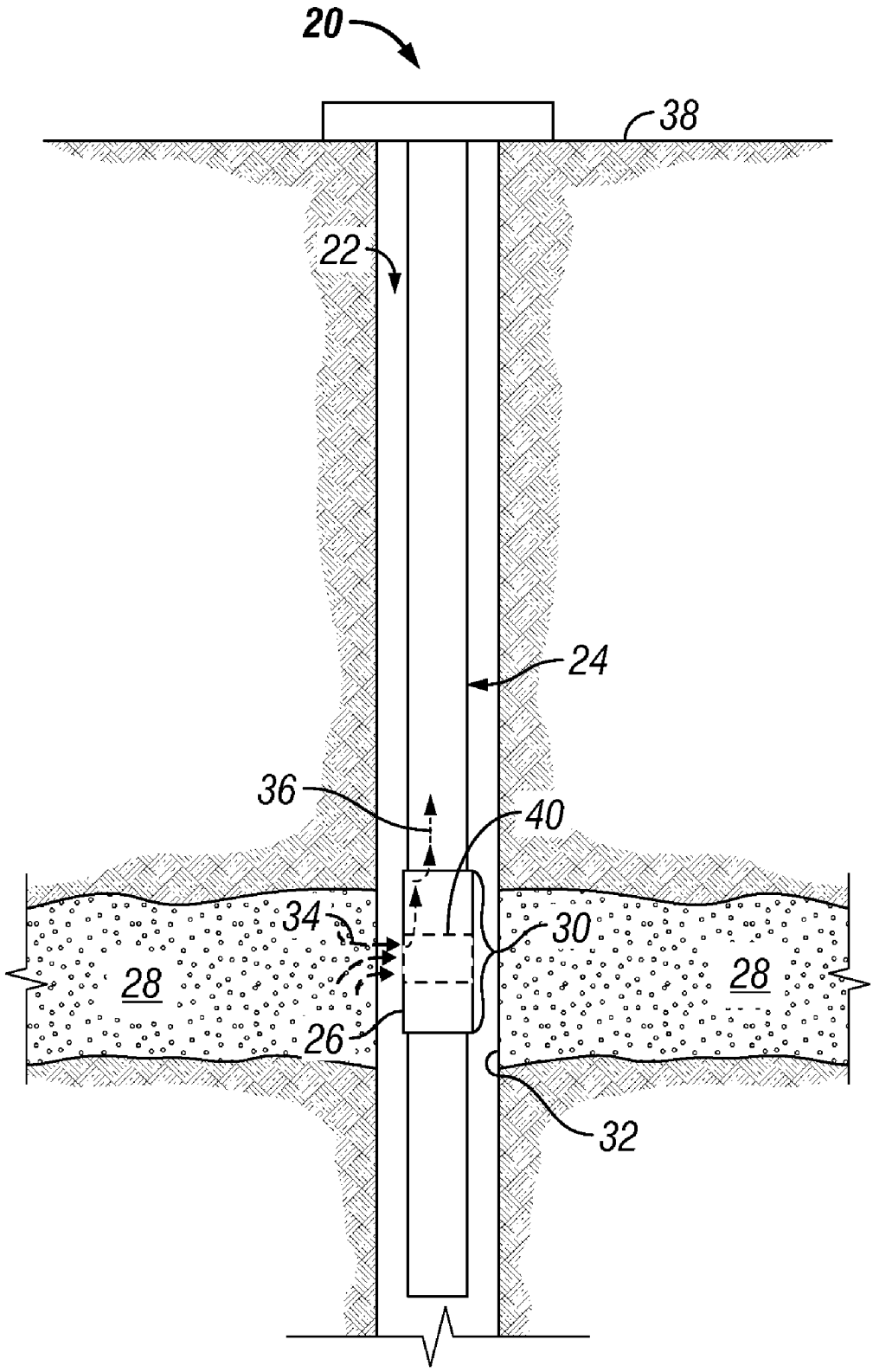
FIG. 1 is a schematic front elevation view of a well system having a single packer through which formation fluids can be collected, according to an embodiment of the present invention.

Referring generally to FIG. 1, one embodiment of a well system 20 is illustrated as deployed in a wellbore 22. The well system 20 comprises a tubing string 24 having at least one packer 26. In this embodiment, packer 26 is a single packer configuration used to collect formation fluids from a surrounding formation 28. The packer 26 is selectively expanded in a radially outward direction to seal across an expansion zone 30 with a surrounding wellbore wall 32, such as a surrounding casing or open wellbore wall. In FIG. 1, packer 26 is illustrated in a contracted configuration, not yet expanded against wellbore wall 32. However, when packer 26 is expanded to seal against wellbore wall 32, formation fluids can be flowed into packer 26, as indicated by arrows 34. The formation fluids are then directed to a tool flow line, as represented by arrows 36, and produced to a collection location, such as a location at a well site surface 38. The production surface through which formation fluid is collected is increased or maximized by restricting expansion of packer 26 at localized regions within expansion zone 30. An anti-expansion device 40 is used to limit the expansion ratio at one or more localized regions along packer 26.

Figure 2:
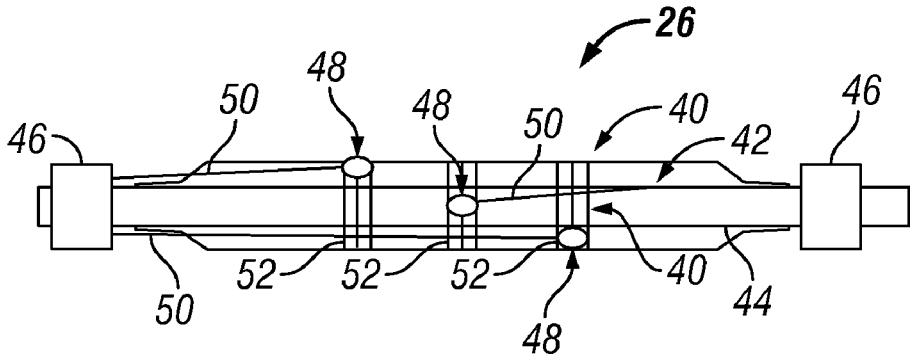
FIG. 2 is a schematic illustration of one example of a packer with an anti-expansion device, according to an embodiment of the present invention.

Referring generally to FIG. 2, single packer 26 is illustrated with one embodiment of anti-expansion device 40. In this embodiment, packer 26 comprises an expandable element 42, such as an inner, inflatable bladder. In one example, the expandable element 42 is selectively expanded by fluid delivered via an inner mandrel 44. Packer 26 also comprises a pair of mechanical fittings 46 that are mounted around inner mandrel 44 at opposed ends of expandable element 42 to collect fluid. A plurality of sample collectors 48 is mounted along expandable element 42 for collecting formation fluid samples. The sample collectors 48 may be in the form of windows or drains disposed within the expansion zone 30. Fluid samples are flowed from sample collectors 48 to mechanical fittings 46 via flow passages 50 which may be in the form of tubes that extend from fluid collectors 48 to one or both of the mechanical fittings 46.

In the illustrated embodiment, anti-expansion device 40 comprises a plurality of reinforcement/anti-expansion rings 52 arranged to restrict expansion of expandable element 42 proximate sample collectors 48. The reinforcement rings 52 can be disposed around or within expandable element 42. For example, if expandable element 42 comprises an inflatable bladder, the reinforcement rings 52 can be disposed around or within the material used to form the inflatable bladder.

Figure 3:
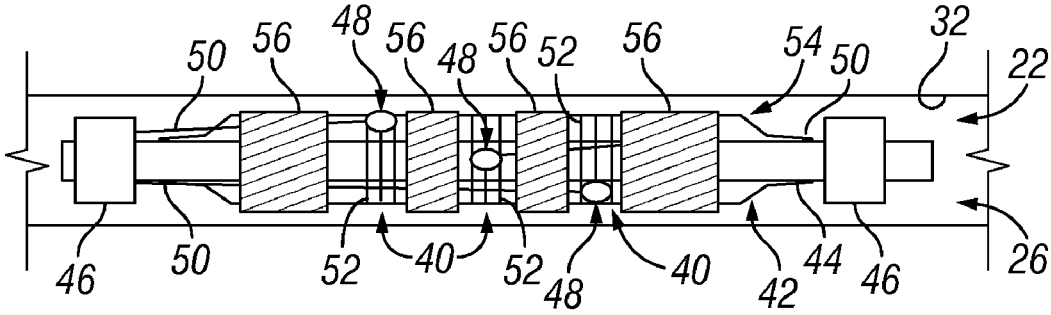
FIG. 3 is an illustration similar to that of FIG. 2 with added sealing elements, according to an embodiment of the present invention.
Figure 4:
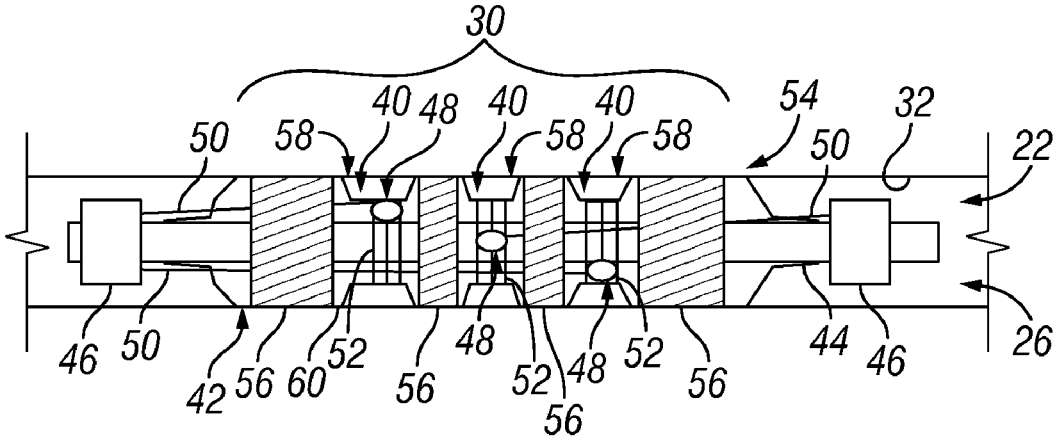
FIG. 4 is a view similar to that of FIG. 3 but showing the packer in an expanded configuration, according to an embodiment of the present invention.

As further illustrated in FIG. 3, packer 26 also may comprise an outer layer 54 that comprises a sealing element 56. Sealing element 56 is designed to seal against surrounding wellbore wall 32 when packer 26 is expanded, as illustrated in FIG. 4. The sealing element 56 may comprise rings arranged between collectors 48, or the sealing element 56 may be a continuous layer having appropriate openings formed to accommodate fluid flow from the surrounding formation into sample collectors 48.

Referring again to FIG. 4, anti-expansion rings 52 limit the expansion ratio of expandable element 42 and overall packer 26 in localized regions 58. Basically, anti-expansion rings 52 control expansion by preventing expandable element 42 from fully expanding in the specific regions while allowing free expansion in the adjacent regions. The controlled expansion ensures that collectors 48 are not pressed into proximity/contact with surrounding wellbore wall 32 and also ensures an increased production surface through which fluid samples flow from surrounding formation 28 into collectors 48.

Figure 5:
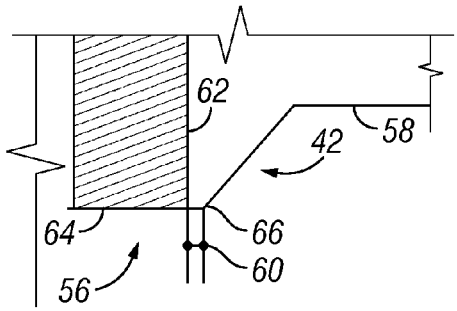
FIG. 5 is a view of an enlarged portion of the packer illustrated in FIG. 4, according to an embodiment of the present invention.

In the embodiment of FIG. 4, sealing element 56 is formed of rings, e.g. rubber rings, mounted over expandable element 42 such that the axial length of each rubber ring is shorter than the length of the corresponding expanded region or zone adjacent localized regions 58. A distance 60 is provided between an axial end 62 of a rubber ring 64 and a beginning edge 66 of the adjacent localized region 58, as illustrated best in FIG. 5. The distance 60 provides an anti-extrusion protection that effectively protects the sealing element 56 from flowing due to the pressure differential and temperature acting on the sealing element. Sealing element 56 may be formed of an elastomeric material selected for hydrocarbon based applications, such as nitrile rubber (NBR), hydrogenated nitrile butadiene rubber (HNBR), and fluorocarbon rubber (FKM).

The anti-expansion rings 52 can be constructed in a variety of forms with a variety of materials, depending on the desired performance of each ring. Additionally, the anti-expansion rings 52 used with a given packer 26 can have differing sizes, constructions and materials. In one embodiment, the anti-expansion rings 52 are designed as non-expandable rings. For example, the rings 52 may be formed of high strength materials, such as steel, stainless steel, or other high strength, corrosion resistant materials. In other applications, the anti-expansion rings 52 can be designed to allow a certain level or degree of expansion in which the expansion rings allow expandable element 42 to expand a portion of the distance toward the surrounding wellbore wall 32.

Figure 6:
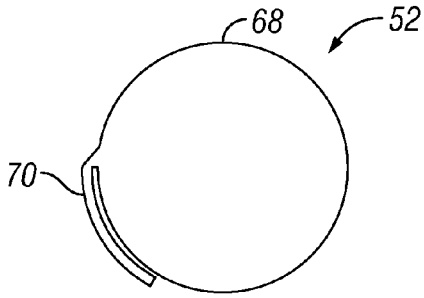
FIG. 6 is a schematic illustration of a member used to form one type of anti-expansion device, according to an embodiment of the present invention.

In the latter example, anti-expansion rings 52 are formed from a material or a combination of materials that are strong while allowing some expansion. One approach to enabling a limited expansion is to form the anti-expansion rings 52 with folded synthetic fibers, as illustrated in FIG. 6. In this example, a folded synthetic fiber 68 is formed as a circular fiber from a strong material. The folded synthetic fiber 68 comprises a folded region 70 that can unfold to allow a certain level of expansion while preventing further expansion once unfolded to the full extension of the circular synthetic fiber. By way of example, each ring 52 can be formed with the corresponding folded synthetic fiber or with a composite material comprising folded synthetic fibers. Examples of suitable folded synthetic fibers include carbon fibers, aramid fibers, glass fibers, or thermoplastic material fibers, e.g. polyetheretherketone, liquid crystal, and other suitable materials.

Figure 7:
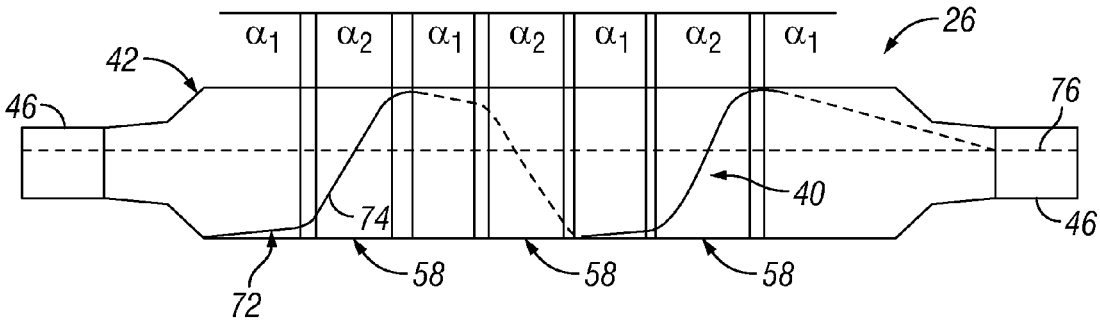
FIG. 7 is a schematic illustration of another example of an anti-expansion device, according to an alternate embodiment of the present invention.

An alternate embodiment of anti-expansion device 40 is illustrated in FIG. 7. In this embodiment, a packer reinforcement structure 72 is used to limit expansion within expansion zone 30 and to thereby create localized regions 58. Packer reinforcement structure 72 may be positioned in cooperation with expandable element 42 or integrated within expandable element 42. For example, expandable element 42 may be formed of a suitable thermoplastic material or a thermoset material with packer reinforcement structure 72 integrated into the material. Examples of thermoplastic materials comprise polyetheretherketone (PEEK) material, polyphenylene sulfide (PPS) material, polyetherimide (PEI) material or other suitable thermoplastic materials. Examples of thermoset materials comprise epoxy, vinylester, phenolic resin, and other suitable thermoset materials. The packer reinforcement structure 72 can be formed from a variety of materials having the strength to restrict expansion, such as steel cables or synthetic fibers embedded in the expandable element 42. Examples of synthetic fibers comprise glass fibers, quartz fibers, carbon fibers, aramid fibers, liquid crystal polymer fibers, and other fibers having suitable characteristics.

The packer reinforcement structure 72 is arranged to limit expansion in localized regions 58 via an angle variation of the packer reinforcement structure. If, for example, packer reinforcement structure 72 comprises a plurality of cables or fibers 74, the cables or fibers are positioned generally longitudinally through, or along, expandable element 42 at predetermined angles relative to a longitudinal packer axis 76. The predetermined angles are selected to restrict expansion of expandable element 42 at the desired localized regions 58, while allowing expansion of expandable element 42 at adjacent regions throughout expansion zone 30.

In one example, the packer reinforcement structure 72 comprises a series of segments labeled $\alpha_1$ and $\alpha_2$ in which the angle relative to packer axis 76 is selected to allow expansion ($\alpha_1$) or to restrict expansion ($\alpha_2$). Although different angles can be selected to control the degree of expansion, the angle in the $\alpha_1$ regions may be in the range between 10° and 20° relative to packer axis 76, which allows free expansion of the packer in these regions. The angle in the $\alpha_2$ regions is substantially larger such that during expansion of expandable element 42, the packer reinforcement structure 72 limits or prevents expansion in those particular regions. Accordingly, cables or fibers can be used to control the expansion of packer 26 in a manner that allows free expansion in certain predetermined regions while limiting or preventing expansion in other localized regions. The one or more localized regions of limited expansion facilitate focused sampling within the expansion zone of a single expandable packer. It should be noted that a variety of packer reinforcement structure angles can be selected pursuant to the desired control over single packer expansion.

Figure 8:
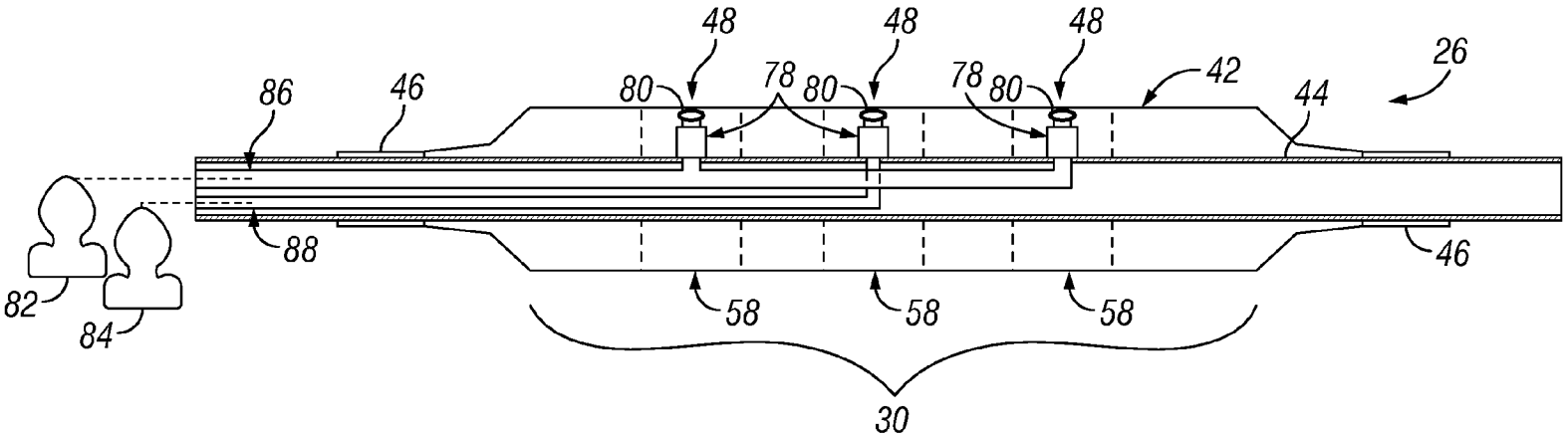
FIG. 8 is a schematic illustration of a single packer with a plurality of sample collectors, according to an embodiment of the present invention.

The fluid samples drawn from surrounding formation 28 can be collected and handled by a variety of mechanisms and packer configurations. In FIG. 8, for example, packer 26 uses collectors 48 in the form of tubes 78 that are telescopic. The telescopic tubes 78 extend through the expandable packer element 42 to inner mandrel 44.

In operation, fluid samples are collected by drawing fluid from the surrounding formation 28 through a port 80 of each collector 48 by creating a pressure differential. The pressure differential can be created by pumps, such as a cleaning pump 82 and a sampling pump 84. In the illustrated example, cleaning pump 82 is connected to outlying collectors 48 via a flow tubing 86, and sampling pump 84 is connected to a middle collector 48 via a flow tubing 88. However, a variety of other arrangements of pumps, tubing, and collectors 48 can be used in other applications.

By placing flow tubing 86 and flow tubing 88 within mandrel 44, bending forces acting on the flow tubing are avoided. As a result, tubes 78 are designed to accommodate at least some expansion and contraction in localized regions 58 during expansion and contraction of packer 26. To the extent such expansion and contraction of the expandable packer element 42 occurs in the localized regions, the telescopic design of each tube 78 allows the entry port to move as needed in a radial direction.

Figure 9:
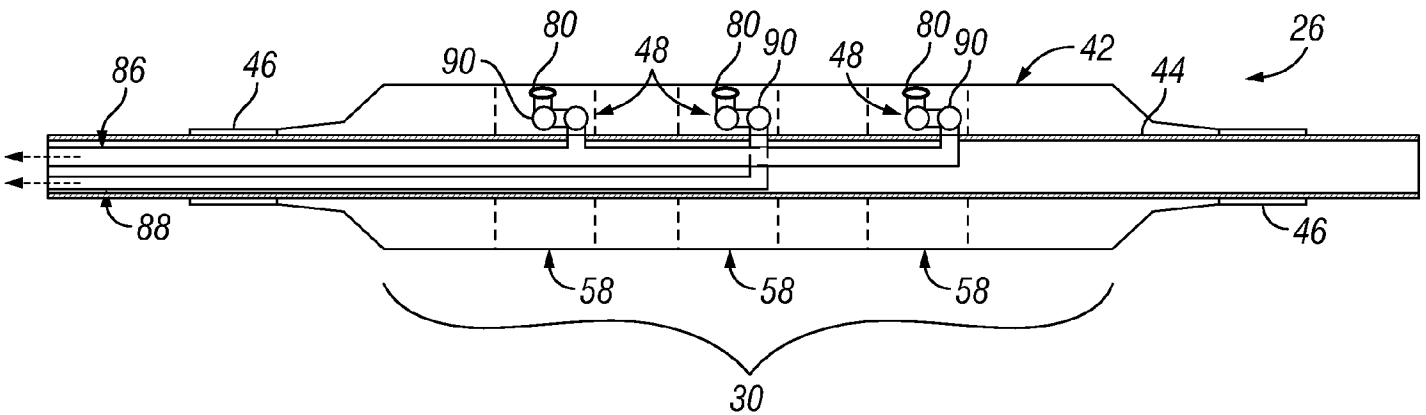
FIG. 9 is a view similar to that of FIG. 8 but showing alternate sample collectors, according to an alternate embodiment of the present invention.

An alternate embodiment is illustrated in FIG. 9. In this embodiment, fluid collected from the formation also is directed along tubing 86 and/or tubing 88 disposed in an interior of inner mandrel 44. However, instead of using telescopic tubes 78, the collectors 48 are formed with articulated tubes 90. The articulated tubes 90 can articulate to move ports 80 of collectors 48 between contracted and expanded positions if expansion and contraction occurs in the localized regions 58.

The overall well system 20 can be constructed in a variety of configurations for use in many environments and applications. Additionally, the single packer 26 can be constructed from a variety of materials and components for collection of formation fluids from single or multiple intervals within a single expansion zone. The restriction of expansion in one or more localized regions provides an increased production surface for drawing in fluid samples from the surrounding formation. The anti-expansion mechanisms used to restrict expansion at these localized regions, however, can be formed with various materials and configurations that are incorporated into expandable packer element 42 or used in cooperation with the expandable packer element. The collectors can be formed as one or more drains, windows, ports or other openings through which the formation fluid flows during collection. Additionally, the number and arrangement of collectors and corresponding flow tubes can vary from one application to another. For example, flow tubing 50, 86, 88 can be deployed within inner mandrel 44, along outer layer 54 or through various other sections of packer 26.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for collecting a fluid sample in a wellbore, comprising:

a single packer having:

an expandable packer element that is expandable across an expansion zone;

a plurality of sample collectors disposed along the expandable packer element; and an anti-expansion device positioned to prevent the plurality of sample collectors from contacting a surrounding wellbore wall when the expandable packer element is expanded in the wellbore, wherein the anti-expansion device comprises a packer reinforcement structure routed through the expandable packer element in a manner that creates localized limited expansion of the expandable packer element.

2. The system as recited in claim 1, wherein the anti-expansion device further comprises a plurality of anti-expansion rings.

3. The system as recited in claim 2, wherein the expandable packer element comprises an inflatable packer element.

4. The system as recited in claim 2, wherein the anti-expansion rings are not expandable.

5. The system as recited in claim 4, wherein the anti-expansion rings are formed from a metallic material.

6. The system as recited in claim 2, wherein the anti-expansion rings allow a limited degree of expansion.

7. The system as recited in claim 6, wherein the anti-expansion rings are formed with folded synthetic fibers.

8. The system as recited in claim 1, wherein the localized limited expansion is controlled by an orientation angle of the packer reinforcement structure.

9. The system as recited in claim 1, further comprising a sealing structure disposed over the expandable packer element to form a seal with the surrounding wellbore wall when the single packer is expanded in the wellbore.

10. The system as recited in claim 1, wherein the packer reinforcement structure comprises metal cables.

11. The system as recited in claim 1, wherein the packer reinforcement structure comprises synthetic fibers embedded in the expandable packer element.

12. A method, comprising:

forming a packer with a plurality of sample collectors disposed along an expandable packer element;

locating an anti-expansion device along the expandable packer element to limit expansion of the expandable packer element at localized regions proximate individual sample collectors of the plurality of sample collectors; and positioning a sealing structure around the expandable packer element to form a seal with a surrounding wellbore wall when the packer is expanded in a wellbore.

13. The method as recited in claim 12, wherein locating comprises locating a plurality of anti-expansion rings along the expandable packer element.

14. The method as recited in claim 12, wherein locating comprises locating a packer reinforcement structure in a generally longitudinal direction through the expandable packer element; and orienting the packer reinforcement structure to provide greater resistance to expansion at the localized regions.

15. The method as recited in claim 12, wherein forming comprises forming each sample collector as a tube that extends through the expandable packer element to an inner mandrel.

16. The method as recited in claim 15, wherein forming comprises forming the tube as a telescopic tube.

17. The method as recited in claim 15, wherein forming comprises forming the tube as an articulated tube.

18. The method as recited in claim 12, further comprising:

constraining expansion of the packer via the anti-expansion device to create individual sample collection zones for each sample collector that do not contact the surrounding wellbore wall.

19. The method as recited in claim 12, further comprising collecting formation fluid samples through the plurality of sample collectors.

20. The method as recited in claim 18, wherein positioning comprises expanding the packer by inflating the packer.

21. A system for collecting a fluid sample, comprising:

a tubing string;

a packer coupled to the tubing string, the packer comprising an expandable packer element, a plurality of sample collectors disposed along the expandable packer element, and an anti-expansion device to limit expansion of the expandable packer element at localized regions between axial ends of the expandable packer element; and a sealing structure disposed around the expandable packer element.

22. The system as recited in claim 21, wherein the expandable packer element comprises an inflatable bladder.

* * * * *